US011812823B2

(12) United States Patent
Van Atta

(10) Patent No.: US 11,812,823 B2
(45) **Date of Patent: *Nov. 14, 2023**

(54) FOOTWEAR HAVING SENSORY FEEDBACK OUTSOLE

(71) Applicant: NIKE, Inc., Beaverton, OR (US)

(72) Inventor: Dylan S. Van Atta, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 37 days.

This patent is subject to a terminal disclaimer.

(21) Appl. No.: 17/131,637

(22) Filed: Dec. 22, 2020

(65) Prior Publication Data

US 2021/0106095 A1 Apr. 15, 2021

Related U.S. Application Data

(63) Continuation of application No. 15/965,654, filed on Apr. 27, 2018, now Pat. No. 10,893,720, which is a (Continued)

(51) Int. Cl.
*A43B 7/00* (2006.01)
*A43B 7/14* (2022.01)

(Continued)

(52) U.S. Cl.
CPC ..... *A43B 7/00* (2013.01); *A43B 7/146* (2013.01); *A43B 7/148* (2013.01); *A43B 7/149* (2013.01);

(Continued)

(58) Field of Classification Search
CPC ..... A43B 5/007; A43B 7/00; A43B 7/146; A43B 7/148; A43B 7/149; A43B 13/122; A43B 13/125; A43B 13/14

(Continued)

(56) References Cited

U.S. PATENT DOCUMENTS 1,313,118 A 8/1919 Santacroce
4,547,978 A * 10/1985 Radford ..... A43B 7/081 36/29

(Continued)

FOREIGN PATENT DOCUMENTS

CN 101589863 12/2009
JP 05115308 5/1993

(Continued)

OTHER PUBLICATIONS

Communication Pursuant to Rules 161(1) and 162 EPC, dated Aug. 25, 2016, for related European Patent Application No. EP14806113.8.

(Continued)

*Primary Examiner* — Sharon M Prange
(74) *Attorney, Agent, or Firm* — Klarquist Sparkman, LLP

(57) ABSTRACT

An article of footwear may include a sole structure fixedly attached to an upper defining an internal cavity configured to receive a foot of a wearer. The sole structure may include an exposed outer member configured to contact the ground, the exposed outer member including a first aperture, and a sensory feedback member disposed at least partially within the first aperture in the outer member, the sensory feedback member including a first end and a second end. The first end of the sensory feedback member may include a projection extending through the first aperture and configured to contact the ground. In addition, the second end of the sensory feedback member may include a plurality of flexible bristles extending through a portion of the sole structure and exposed to the internal cavity.

14 Claims, 13 Drawing Sheets

Related U.S. Application Data continuation of application No. 14/154,786, filed on Jan. 14, 2014, now Pat. No. 9,955,749.

(51) Int. Cl.

| | |
|---|---|
| ***A43B 13/12*** | (2006.01) |
| ***A43B 13/14*** | (2006.01) |
| ***A43B 7/1455*** | (2022.01) |
| ***A43B 7/148*** | (2022.01) |
| ***A43B 7/149*** | (2022.01) |
| ***A43C 15/14*** | (2006.01) |

(52) U.S. Cl.

CPC ..... *A43B 13/122* (2013.01); *A43B 13/125* (2013.01); *A43B 13/14* (2013.01); *A43C 15/14* (2013.01)

(58) Field of Classification Search

USPC ..... 36/25 R, 28, 30 R, 114, 141

See application file for complete search history.

(56) References Cited

U.S. PATENT DOCUMENTS

| | | | | | |
|---|---|---|---|---|---|
| 4,715,133 | A * | 12/1987 | Hartjes | A43C 15/14 | 36/134 |
| 4,823,799 | A | 4/1989 | Robbins | | |
| 4,831,749 | A * | 5/1989 | Tsai | A43B 17/08 | 36/43 |
| 5,322,056 | A | 6/1994 | Menghi et al. | | |
| 5,369,896 | A | 12/1994 | Frachey et al. | | |
| 5,400,526 | A | 3/1995 | Sessa | | |
| 5,768,802 | A * | 6/1998 | Bramani | A43B 7/146 | 36/35 R |
| 5,827,596 | A | 10/1998 | Donohue | | |
| 5,992,052 | A * | 11/1999 | Moretti | A43B 7/125 | 36/103 |
| 6,082,024 | A * | 7/2000 | Del Biondi | A43B 7/14 | 601/134 |
| 6,516,540 | B2 | 2/2003 | Seydel et al. | | |
| 6,691,432 | B2 | 2/2004 | Masseron | | |
| 6,732,457 | B2 | 5/2004 | Gardiner | | |
| 6,951,066 | B2 | 10/2005 | Snow | | |
| 7,069,672 | B2 | 7/2006 | Hahn | | |
| 7,200,955 | B2 * | 4/2007 | Foxen | A43B 13/189 | 36/31 |
| 7,918,041 | B2 * | 4/2011 | Cho | A43B 7/081 | 36/28 |
| 8,220,182 | B2 * | 7/2012 | Righetto | A43B 13/184 | 36/141 |
| 8,387,281 | B2 | 3/2013 | Loverin et al. | | |
| 8,453,345 | B2 | 6/2013 | Evans et al. | | |
| 9,144,264 | B2 * | 9/2015 | Marvin | A43B 13/188 | |
| 9,192,205 | B2 * | 11/2015 | McDowell | A43B 5/08 | |
| 9,504,293 | B2 * | 11/2016 | Tsang | A43B 13/184 | |
| 9,516,917 | B2 * | 12/2016 | Hoffer | A43C 15/14 | |
| 2004/0006888 | A1 * | 1/2004 | Moretti | A43B 7/06 | 36/3 B |
| 2008/0313924 | A1 | 12/2008 | Righetto | | |
| 2009/0293305 | A1 | 12/2009 | Pelsue et al. | | |
| 2010/0126043 | A1 | 5/2010 | Loverin et al. | | |
| 2011/0192056 | A1 * | 8/2011 | Geser | A43B 13/26 | 36/114 |
| 2012/0073162 | A1 | 3/2012 | Martinez | | |
| 2012/0233885 | A1 | 9/2012 | Shaffer et al. | | |
| 2012/0240432 | A1 * | 9/2012 | Lambertz | A43B 7/146 | 36/25 R |
| 2012/0266494 | A1 * | 10/2012 | Ko | A43B 7/087 | 36/30 R |
| 2013/0036631 | A1 | 2/2013 | Nabernik | | |
| 2013/0212905 | A1 | 8/2013 | Hazenberg et al. | | |

FOREIGN PATENT DOCUMENTS

| | | |
|---|---|---|
| JP | 2010017514 | 1/2010 |
| WO | WO 2008/058147 | 5/2008 |

OTHER PUBLICATIONS

International Search Report and Written Opinion, dated Feb. 4, 2015, in related PCT/US2014/062190, 13 pages.

International Preliminary Report of Patentability, dated Jul. 28, 2016, for related PCT/US2014/062190.

Office Action, dated Feb. 28, 2017, for related Chinese Patent Application No. 201480075201.6, 5 pages.

Office Action, dated Aug. 1, 2017, for related Chinese Patent Application No. 201480075201.6, 3 pages.

* cited by examiner

FOOTWEAR HAVING SENSORY FEEDBACK OUTSOLE

CROSS REFERENCE TO RELATED APPLICATIONS

This application is a continuation of U.S. patent application Ser. No. 15/965,654, filed Apr. 27, 2018, which is a continuation of U.S. patent application Ser. No. 14/154,786, filed Jan. 14, 2014, now U.S. Pat. No. 9,955,749. The prior applications are incorporated herein by reference in their entirety.

FIELD

The present disclosure is directed to an article of footwear and, more particularly, to an article of footwear having sensory feedback members incorporated into the outsole.

BACKGROUND

The present disclosure is directed to an article of footwear and, more particularly, to an article of footwear having sensory feedback members incorporated into the outsole.

Conventional articles of athletic footwear include two primary elements, an upper and a sole structure. The upper provides a covering for the foot that comfortably receives and securely positions the foot with respect to the sole structure. The sole structure is secured to a lower portion of the upper and is generally positioned between the foot and the ground. In addition to attenuating ground reaction forces (that is, providing cushioning) during walking, running, and other ambulatory activities, the sole structure may influence foot motions (for example, by resisting pronation), impart stability, and provide traction, for example. Accordingly, the upper and the sole structure operate cooperatively to provide a comfortable structure that is suited for a wide variety of athletic activities.

The upper is often formed from a plurality of material elements (for example, textiles, polymer sheets, foam layers, leather, and synthetic leather) that are stitched or adhesively bonded together to define a void or cavity on the interior of the footwear for comfortably and securely receiving a foot. More particularly, the upper forms a structure that extends over instep and toe areas of the foot, along medial and lateral sides of the foot, and around a heel area of the foot. The upper may also incorporate a lacing system to adjust fit of the footwear, as well as permit entry and removal of the foot from the void within the upper. In addition, the upper may include a tongue that extends under the lacing system to enhance adjustability and comfort of the footwear, and the upper may incorporate a heel counter or other stabilizing structure.

The sole structure may include various components to control ground reaction forces. The sole structure may include an outer member (outsole) configured to contact the ground. The sole structure may also include a midsole, which may include one or more cushioning elements.

In some cases, the provision of cushioning elements in a sole structure, while attenuating ground reaction forces, may undesirably reduce sensory feedback by isolating the foot of the wearer from the ground contact. The sole structure may include provisions for increasing sensory feedback in a cushioned sole structure.

SUMMARY

In some embodiments, an article of footwear may have a sole structure that incorporates a plurality of sensory feedback members. The sensory feedback members may transmit lateral loads from the ground contacting portions of the outsole to the soles of the foot. In some embodiments, the sensory feedback members may include firm rubber elements disposed within apertures in the sole structure and extending completely through the sole structure, being exposed to both the exterior of the sole structure and the internal cavity within the shoe.

In one aspect, the present disclosure is directed to an article of footwear. The article of footwear may include a sole structure fixedly attached to an upper defining an internal cavity configured to receive a foot of a wearer. The sole structure may include an exposed outer member configured to contact the ground, the exposed outer member including a first aperture, and a sensory feedback member disposed at least partially within the first aperture in the outer member, the sensory feedback member including a first end and a second end. The first end of the sensory feedback member may include a projection extending through the first aperture and configured to contact the ground. In addition, the second end of the sensory feedback member may include a plurality of flexible bristles extending through a portion of the sole structure and exposed to the internal cavity.

In another aspect, the present disclosure is directed to an article of footwear. The article of footwear may include a sole structure fixedly attached to an upper defining an internal cavity configured to receive a foot of a wearer. The sole structure may include a sensory feedback member including a first end and a second end. The first end of the sensory feedback member may be configured to contact the ground. In addition, the second end of the sensory feedback member may include a plurality of flexible bristles extending through a portion of the sole structure and exposed to the internal cavity. Further, the sensory feedback member may be configured such that the first end deflects in a first substantially horizontal direction under lateral loading of the projection and the bristles at the second end deflect in a second substantially horizontal direction opposite the first substantially horizontal direction.

In another aspect, the present disclosure is directed to an article of footwear including a sole structure fixedly attached to an upper defining an internal cavity configured to receive a foot of a wearer. The sole structure may include a sensory feedback member including a first end and a second end. The first end of the sensory feedback member may be configured to contact the ground and deflect multi-axially in substantially horizontal directions. Also, the second end of the sensory feedback member may extend through a portion of the sole structure and being exposed to the internal cavity. In addition, the second end of the sensory feedback member may be configured to deflect multi-axially in substantially horizontal directions. Further, the second end of the sensory feedback member may be configured to deflect in a direction opposite to the direction in which the first end of the sensory feedback member is deflected.

Other systems, methods, features and advantages of the current embodiments will be, or will become, apparent to one of ordinary skill in the art upon examination of the following figures and detailed description. It is intended that all such additional systems, methods, features and advantages be included within this description and this summary, be within the scope of the current embodiments, and be protected by the following claims.

BRIEF DESCRIPTION OF THE DRAWINGS

The current embodiments can be better understood with reference to the following drawings and description. The drawings are schematic. Accordingly, the components in the figures are not necessarily to scale, with emphasis instead being placed upon illustrating the principles of the current embodiments. Moreover, in the figures, like reference numerals designate corresponding parts throughout the different views.

DETAILED DESCRIPTION

Figure 1:
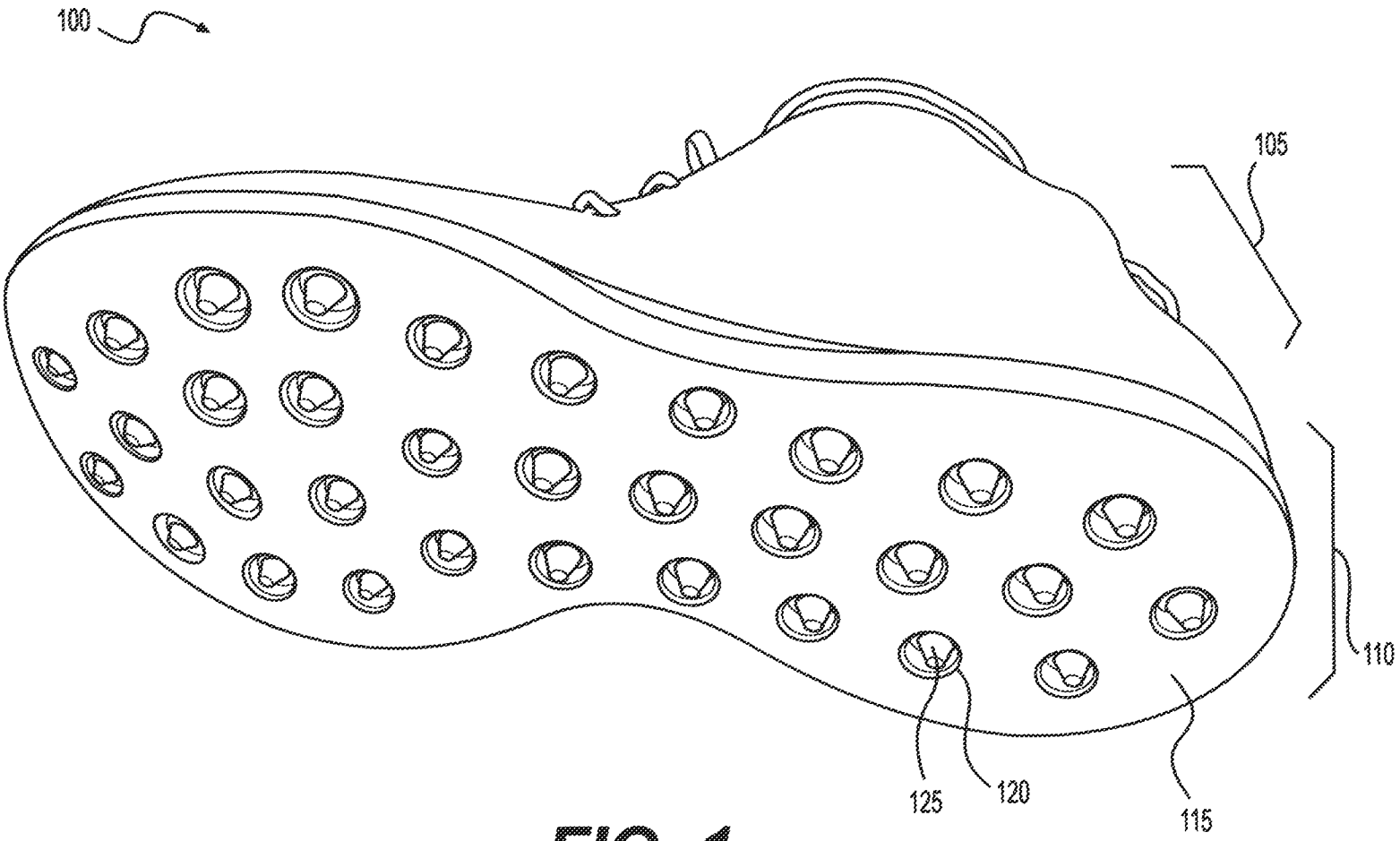
FIG. 1 is a schematic illustration of lower perspective view of an embodiment of an article of footwear having sensory feedback members incorporated into the sole structure.

The following discussion and accompanying figures disclose a sole structure for an article of footwear. Concepts associated with the footwear disclosed herein may be applied to a variety of athletic footwear types, including skateboarding shoes, performance driving shoes, soccer shoes, running shoes, baseball shoes, basketball shoes, cross-training shoes, cycling shoes, football shoes, golf shoes, tennis shoes, walking shoes, and hiking shoes and boots, for example. The concepts may also be applied to footwear types that are generally considered to be non-athletic, including dress shoes, loafers, sandals, and work boots. Accordingly, the concepts disclosed herein apply to a wide variety of footwear types.

For consistency and convenience, directional adjectives are employed throughout this detailed description corresponding to the illustrated embodiments. The term "longitudinal," as used throughout this detailed description and in the claims, refers to a direction extending a length of a sole structure, i.e., extending from a forefoot portion to a heel portion of the sole. The term "forward" is used to refer to the general direction in which the toes of a foot point, and the term "rearward" is used to refer to the opposite direction, i.e., the direction in which the heel of the foot is facing.

The term "lateral direction," as used throughout this detailed description and in the claims, refers to a side-to-side direction extending a width of a sole. In other words, the lateral direction may extend between a medial side and a lateral side of an article of footwear, with the lateral side of the article of footwear being the surface that faces away from the other foot, and the medial side being the surface that faces toward the other foot.

The term "lateral axis," as used throughout this detailed description and in the claims, refers to an axis oriented in a lateral direction.

The term "horizontal," as used throughout this detailed description and in the claims, refers to any direction substantially parallel with the ground, including the longitudinal direction, the lateral direction, and all directions in between. Similarly, the term "side," as used in this specification and in the claims, refers to any portion of a component facing generally in a lateral, medial, forward, and/or rearward direction, as opposed to an upward or downward direction.

The term "vertical," as used throughout this detailed description and in the claims, refers to a direction generally perpendicular to both the lateral and longitudinal directions. For example, in cases where a sole is planted flat on a ground surface, the vertical direction may extend from the ground surface upward. It will be understood that each of these directional adjectives may be applied to individual components of a sole. The term "upward" refers to the vertical direction heading away from a ground surface, while the term "downward" refers to the vertical direction heading towards the ground surface. Similarly, the terms "top," "upper," and other similar terms refer to the portion of an object substantially furthest from the ground in a vertical direction, and the terms "bottom," "lower," and other similar terms refer to the portion of an object substantially closest to the ground in a vertical direction.

For purposes of this disclosure, the foregoing directional terms, when used in reference to an article of footwear, shall refer to the article of footwear when sitting in an upright position, with the sole facing groundward, that is, as it would be positioned when worn by a wearer standing on a substantially level surface.

In addition, for purposes of this disclosure, the term "fixedly attached" shall refer to two components joined in a manner such that the components may not be readily separated (for example, without destroying one or both of the components). Exemplary modalities of fixed attachment may include joining with permanent adhesive, rivets, stitches, nails, staples, welding or other thermal bonding, and/or other joining techniques. In addition, two components may be "fixedly attached" by virtue of being integrally formed, for example, in a molding process.

FIG. 1 depicts an embodiment of an article of footwear 100, which may include an upper 105 and a sole structure 110 secured to upper 105. Sole structure 110 may be fixedly attached to upper 105. As shown in FIG. 1, sole structure 110 may include an exposed outer member 115 configured to contact the ground. Upper 105 may define an internal cavity configured to receive a foot of a wearer.

The disclosed footwear components may be formed of any suitable materials. In some embodiments, one or more materials disclosed in Lyden et al. (U.S. Pat. No. 5,709,954), which is hereby incorporated by reference in its entirety, may be used. Upper 105 may include one or more material elements (for example, textiles, foam, leather, and synthetic leather), which may be stitched, adhesively bonded, molded, or otherwise formed to define an interior cavity configured to receive a foot. The material elements may be selected and arranged to selectively impart properties such as durability, air-permeability, wear-resistance, flexibility, and comfort.

Sole structure 110 may be fixedly attached to upper 105 (for example, with adhesive, stitching, welding, and/or other suitable techniques) and may have a configuration that extends between upper 105 and the ground. Sole structure 110 may include provisions for attenuating ground reaction forces (that is, cushioning the foot). In addition, sole structure 110 may be configured to provide traction, impart stability, and/or limit various foot motions, such as pronation, supination, and/or other motions.

The configuration of sole structure 110 may vary significantly according to one or more types of ground surfaces on which sole structure 12 may be used, for example, natural turf, synthetic turf, dirt, pavement (for example, asphalt, concrete, and other types of pavement), as well as indoor surfaces, such as hardwood, synthetic rubber surfaces, tile, and other indoor surfaces. In addition, the configuration of sole structure 110 may vary significantly according to the type of activity for which footwear 100 is anticipated to be used (for example, skateboarding, driving, running, walking, soccer, baseball, basketball, and other activities). Footwear 100 is depicted in the accompanying figures as a shoe, having a sole structure suited for a variety of activities including, for example, skateboarding or performance driving. Although footwear 100, as depicted, may be suited for skateboarding or driving, such a shoe may be applicable for use in other activities.

In some embodiments, sole structure 110 may include multiple components, which may individually and/or collectively provide footwear 110 with a number of attributes, such as support, rigidity, flexibility, stability, cushioning, comfort, reduced weight, traction, and/or other attributes. Outer member 115 of sole structure 110 may be formed of suitable materials for achieving the desired performance attributes. Outer member 115 may be formed of any suitable rubber, polymer, composite, and/or metal alloy materials. Exemplary such materials may include thermoplastic and thermoset polyurethane, polyester, nylon, polyether block amide, alloys of polyurethane and acrylonitrile butadiene styrene, carbon fiber, poly-paraphenylene terephthalamide (para-aramid fibers, e.g., Kevlar®), titanium alloys, and/or aluminum alloys. In some embodiments, outer member 115 may be fashioned from a durable and wear-resistant material (for example, rubber). Other suitable materials will be recognized by those having skill in the art.

Outer member 115 may include a ground engaging lower surface configured to engage the ground. Sole structure 110 may also include other components, such as an insole (sockliner), midsole, and/or chassis plate. The insole may be a thin, compressible member located (in some cases removably) within the upper and adjacent to a plantar (that is, lower) surface of the foot to provide comfort, support, and stability. The midsole may be secured to a lower surface of the upper and may form a middle layer of the sole structure. Many midsole configurations are primarily formed from a resilient polymer foam material, such as polyurethane (PU) or ethyl vinyl acetate (EVA) that extends throughout the length and width of the footwear. The midsole may also incorporate plates, moderators, fluid-filled chambers, and/or other elements that further attenuate forces, influence the motions of the foot, and/or impart stability, for example.

Selection and configuration of the insole, midsole, and chassis plate may be based on the activity and athlete for which article of footwear 100 is configured. In some cases, one or more such components may be omitted from sole structure 110. For example, in some embodiments, the disclosed footwear 100 may omit an insole. In some embodiments, a chassis plate may be incorporated into outer member 115.

In various athletic activities, loading and impacts to which footwear (and consequently the wearer's feet) are subjected may be much higher than, for example, walking or jogging. Nevertheless, the execution of many skills involved in such athletic activities may be performed based on precise placement and interaction of the wearer's feet with the surface on which the activities are performed. Therefore, the use of substantial cushioning elements in the sole structure of footwear used in such activities may reduce the amount that the wearer can feel the surface through the soles of the footwear. This may adversely affect their ability to position their feet and interact with the surface on which the activity is performed. In skateboarding the athlete's feet may be subjected to significantly elevated loading, for example, when performing tricks involving jumps or drops from significant heights. The impacts upon landing can be much higher than in walking, jogging, or other athletic activities. However, skateboarders often prefer thin-soled shoes for skateboarding because the thin soles provide better feel of the board surface, which enables the skateboarders to precisely position their feet in order to execute tricks.

Similarly, performance driving shoes typically include relatively thin soles to provide precise feel of the pedals of the racecar. However, it would be beneficial to utilize a thicker sole in order to provide increased thermal insulation for a driver's feet during races.

In some embodiments, the disclosed footwear may include a more cushioned, and possibly thicker, sole structure and may include one or more sensory feedback members configured to transmit sensory feedback from the surface on which the activity is performed to the soles of the wearer's feet. For example, in some embodiments, the sole structure may include sensory feedback members extending from the exposed lower surface of the outsole through to the inner exposed surface of the sole structure within the internal cavity of the footwear.

FIG. 1 is a schematic illustration of lower perspective view of footwear 100. As shown in FIG. 1, sole structure 110 may include at least one sensory feedback member 125. Sensory feedback member 125 may be exposed through an aperture 120 in outer member 115. Accordingly, a portion of sensory feedback member 125 may be exposed and configured to contact the ground.

In some embodiments, sole structure 110 may include a plurality of sensory feedback members having configurations substantially similar to sensory feedback member 125.

The plurality of sensory feedback members may be arranged selectively to provide sensory feedback at particular portions of the foot. While FIG. 1 illustrates an embodiment that provides sensory feedback members for substantially all regions of the foot, in some embodiments, sole structure 110 may include sensory feedback members corresponding with some portions of the foot and not others. For example, in some embodiments, sensory feedback members may be provided only in the forefoot region of footwear 100. In some embodiments, sensory feedback members may be provided in a forefoot region and heel region, but not in a midfoot region of footwear 100.

Further, the sizing of the sensory feedback members may vary in order to provide desired performance for the activity for which footwear 100 is to be used. Further, the density or proximity of sensory feedback members to one another may also vary according to performance considerations. One performance factor that may be considered is weight. Sensory feedback members may be formed from a relatively firm rubber material and may replace relatively lightweight foam material in sole structure 110. Accordingly, it may be desirable to use a minimum number of sensory feedback members in order to maintain a low weight for footwear 100.

Figure 2:
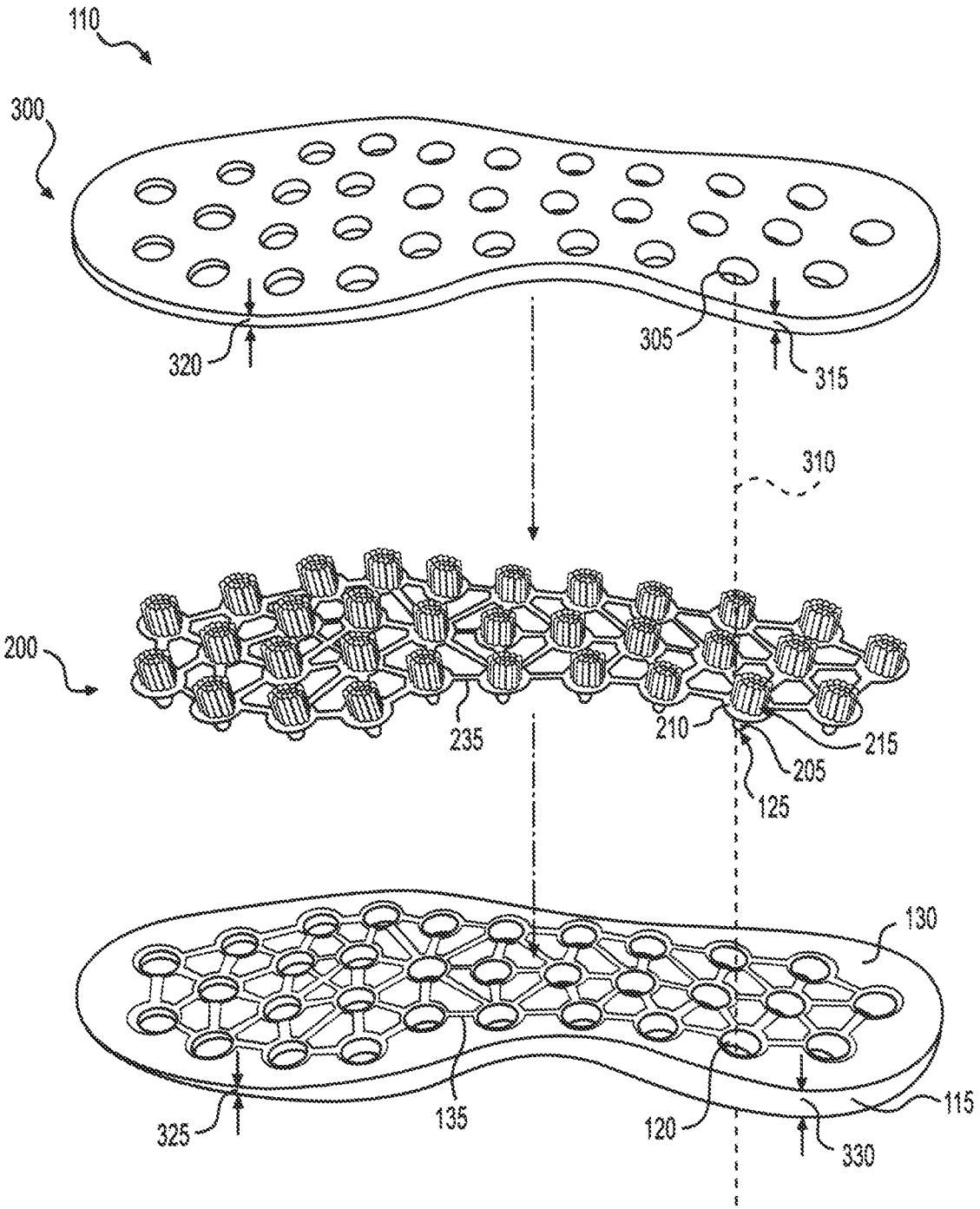
FIG. 2 is a schematic illustration of an exploded top perspective view of the sole structure of the article of footwear shown in FIG. 1.
Figure 3:
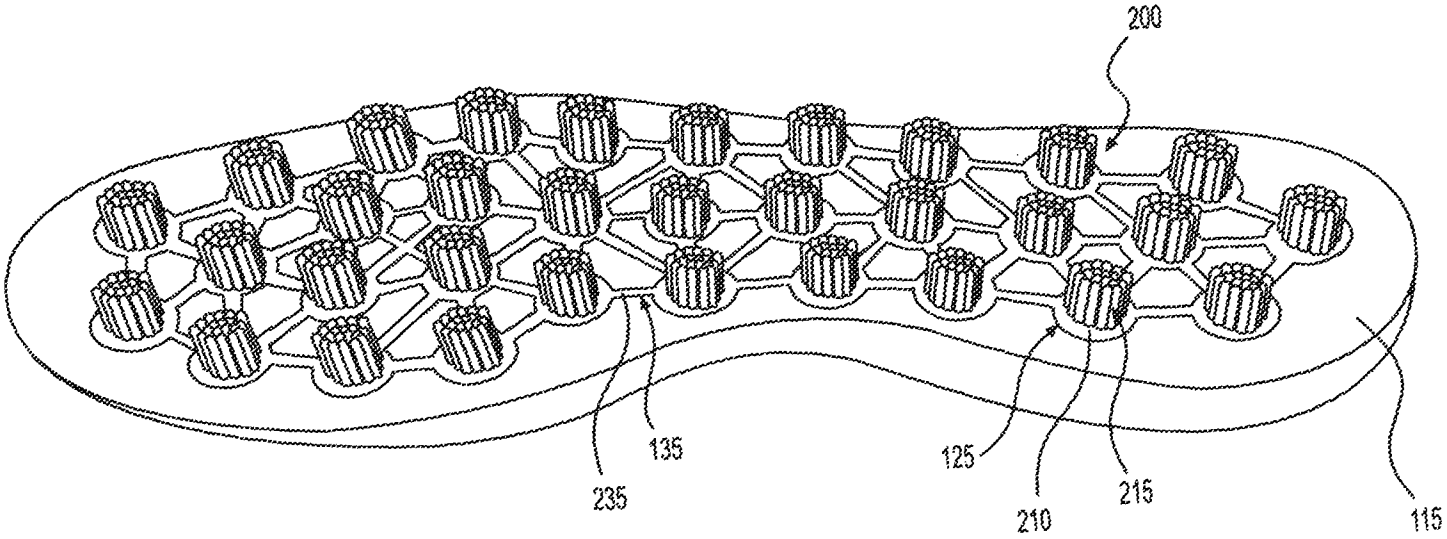
FIG. 3 is a schematic illustration of a partial assembly of the sole structure shown in FIG. 2.
Figure 4:
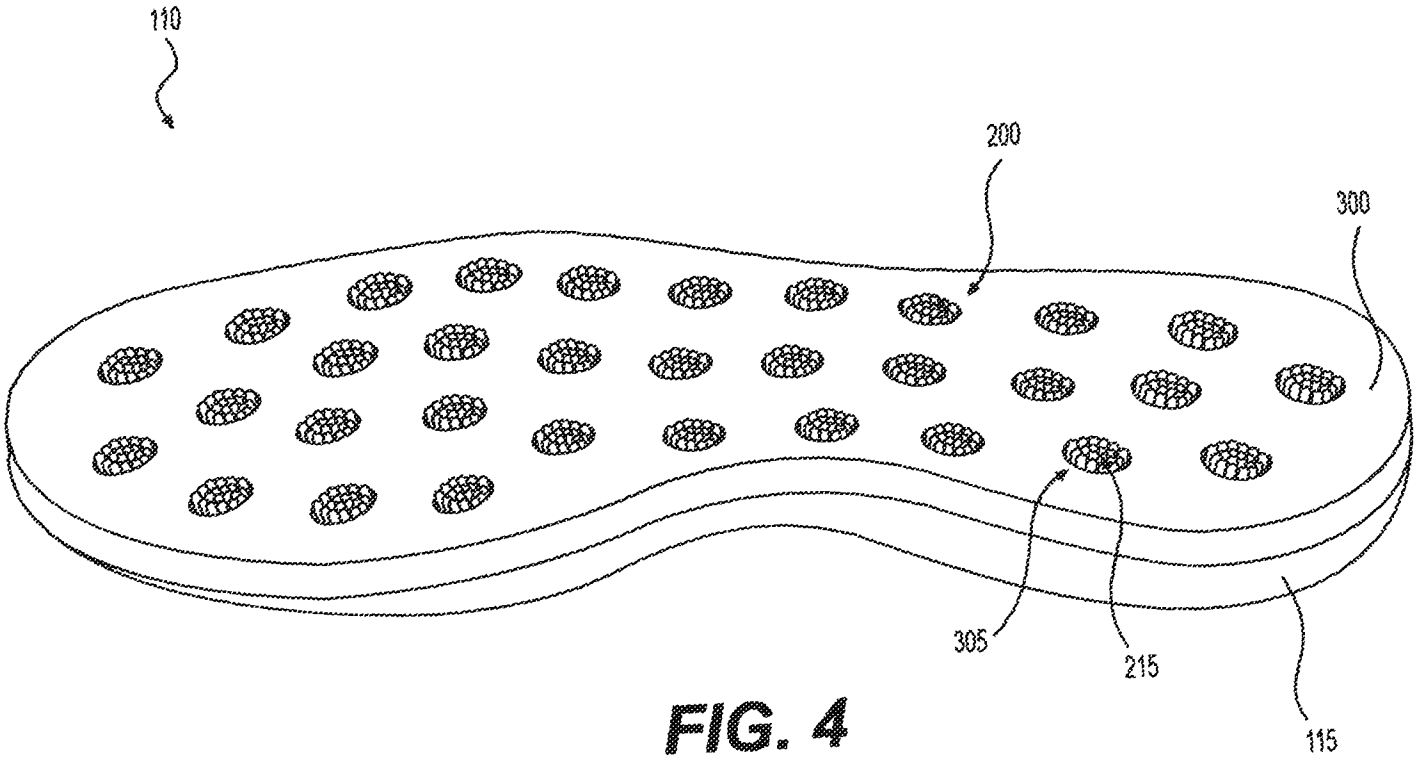
FIG. 4 is a schematic illustration of the sole structure shown in FIG. 2 in an assembled condition.

FIGS. 2-4 illustrate the assembly of sole structure 110. FIG. 2 is an exploded top perspective view of sole structure 110. As shown in FIG. 2, outer member a plurality of apertures 120 configured to receive a plurality of sensory feedback members 125. As shown in FIG. 2, sensory feedback members 125 may have a substantially round configuration and, accordingly, apertures 120 may have a substantially cylindrical configuration in order to receive sensory feedback members 125.

Each sensory feedback members 125 may include a first end and a second end. The first end may include a projection 205 configured to be received within apertures 120. The second end may include a plurality of bristles 215. In addition, sensory feedback members 125 may also include a flange portion 210 between projection 205 and bristles 215. Flange portion 210 may facilitate the securing of sensory feedback members 125 within sole structure 110.

As shown in FIG. 2, sole structure 110 may also include a midsole 300 configured to be disposed between outer member 115 and the upper. Midsole 300 may include a plurality of apertures 305 configured to receive the bristles of sensory feedback members 125. In some embodiments, apertures 305 may also be substantially cylindrical. Upon this assembly, aperture 120 and sensory feedback member 125 and aperture 305 may be aligned, as illustrated by axis 310.

In some embodiments, outer member 115 may be tapered. For example, as illustrated in FIG. 2, a forefoot portion of outer member 115 may have a first thickness 325 and a heel portion of outer member 115 may have a second thickness 330, wherein second thickness 330 is larger than first thickness 325. In other embodiments, outer member 115 may have a substantially consistent thickness.

In some embodiments midsole 300 may have a substantially consistent thickness. For example, as shown in FIG. 2, a forefoot portion of midsole 300 may have a first thickness 320 and a heel portion of midsole 300 may have a second thickness 315, wherein first thickness 320 and second thickness 315 are substantially the same. In other embodiments, midsole 300 may have varying thickness.

In some embodiments, the plurality of sensory feedback members 125 may be linked to one another with a lattice of elongate connecting members 235, thereby forming a lattice structure 200. As shown in FIG. 2, an upper surface 130 of outer member 115 may include a recessed pattern 135. Recessed pattern 135 may be configured to receive the elongate connecting members 235 and flange members 210 of sensory feedback members 125, as shown in FIG. 3. With lattice structure 200 assembled with outer member 115, midsole 300 may be assembled with outer member 115, thus sandwiching lattice structure 200 between outer member 115 and midsole 300, as shown in FIG. 4, thereby securing sensory feedback members 125 within sole structure 110.

Figure 5:
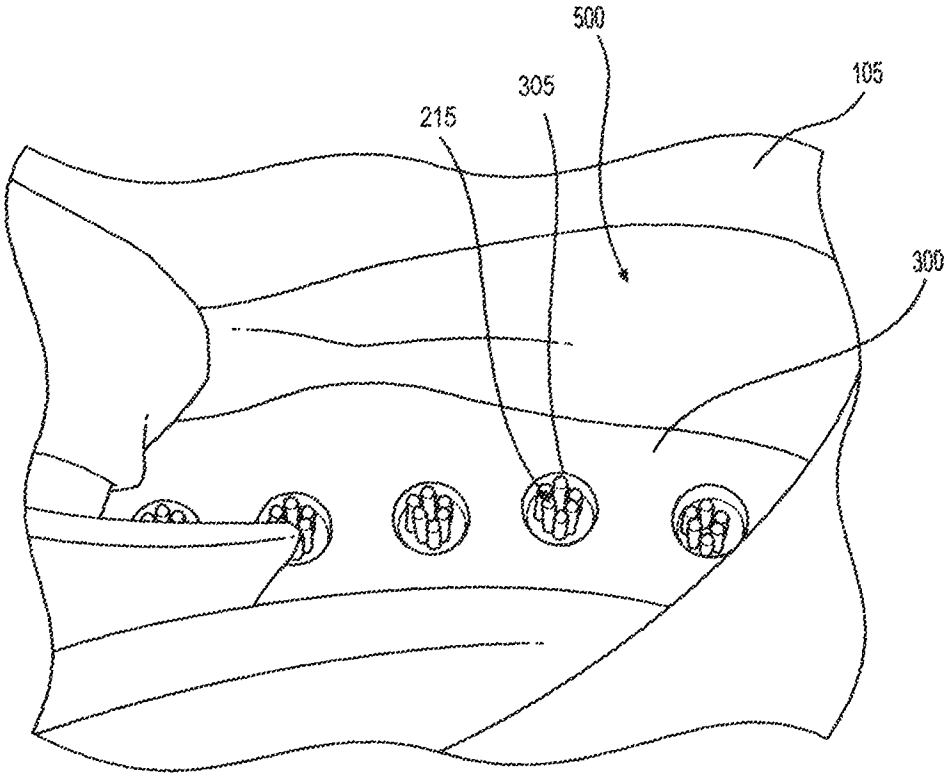
FIG. 5 is a schematic illustration of an internal cavity of an article of footwear showing exposed sensory feedback members in the sole structure.

As shown in FIG. 4, when midsole 300 is assembled with lattice structure 200 and outer member 115, bristles 215 may extend through aperture 305. As shown in FIG. 5, bristles 215 may extend through a portion of the sole structure, including midsole 300 and may be exposed to an internal cavity 500 defined by upper 105. Accordingly, bristles 215 may contact the foot of the wearer, and thus, may transmit sensory feedback to the foot.

Figure 6:
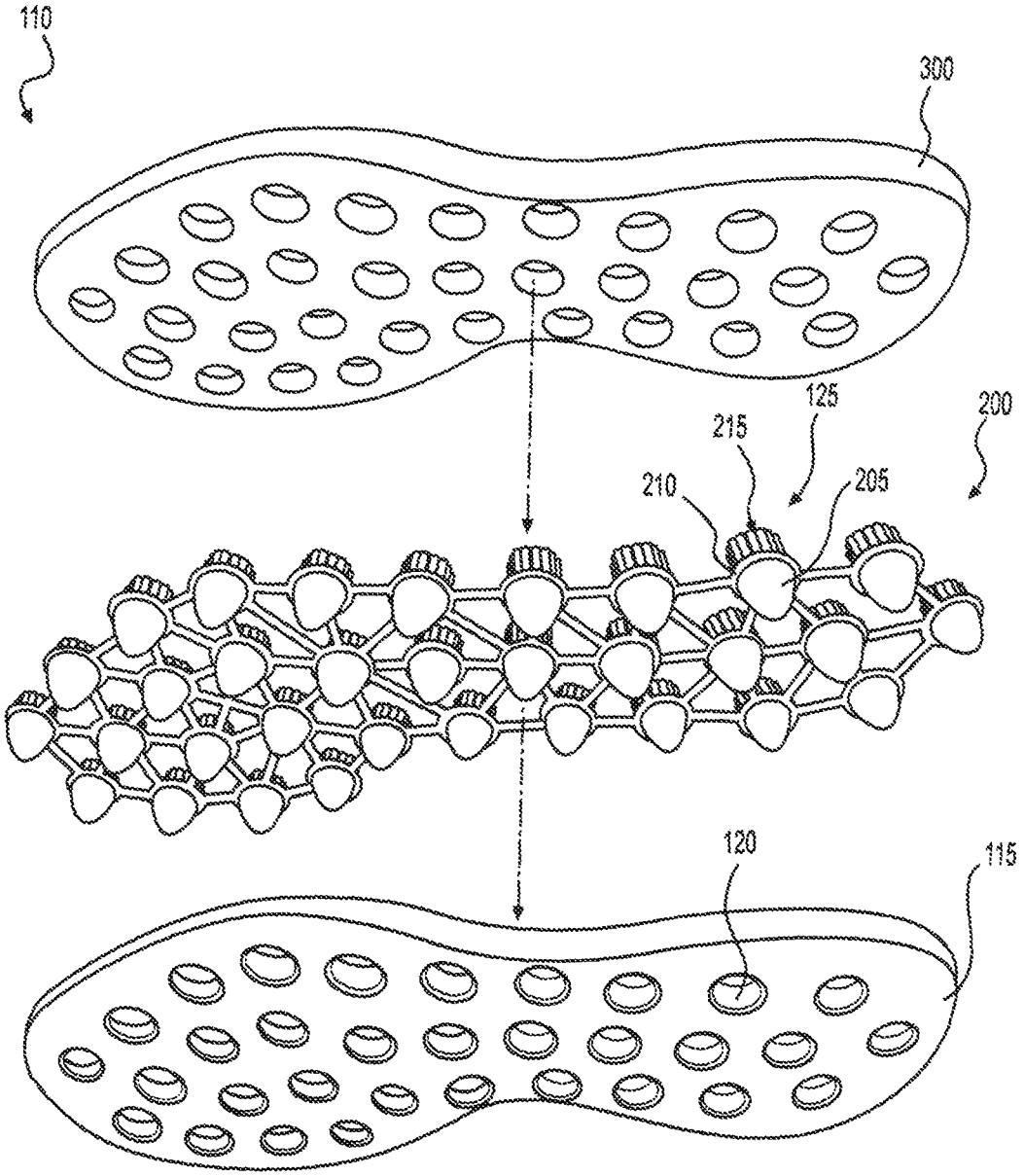
FIG. 6 is a schematic illustration of an exploded bottom perspective view of the sole structure of the article of footwear shown in FIG. 1.
Figure 7:
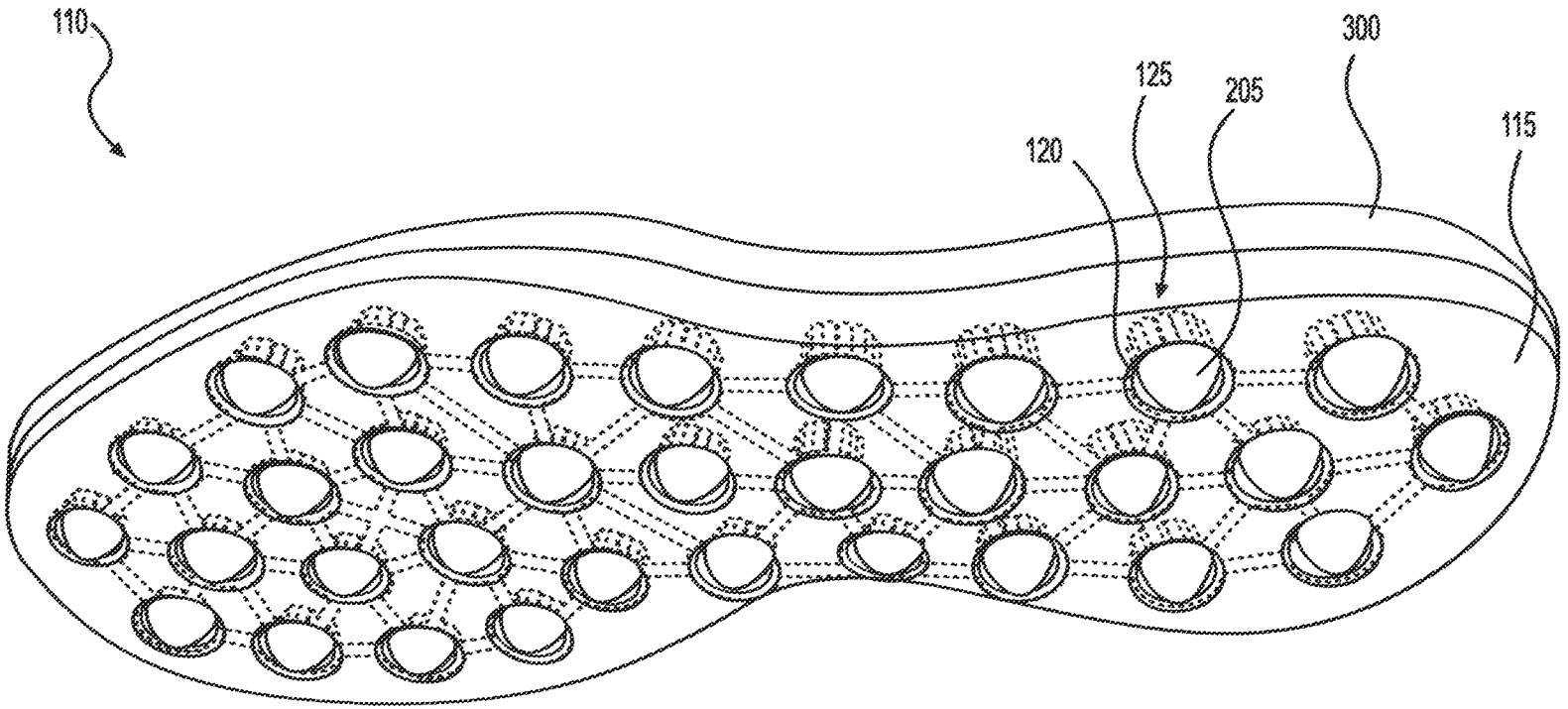
FIG. 7 is a schematic illustration of the sole structure shown in FIG. 6 in an assembled condition.

FIGS. 6 and 7 illustrate the assembly of sole structure 110 from a bottom perspective view. FIG. 6 is an exploded bottom perspective view of sole structure 110. As shown in FIG. 6, in some embodiments, projections 205 may have a substantially rounded configuration. For example, as shown in FIG. 6, projections 205 may have a rounded, substantially conical configuration. In other embodiments, projections 205 may have other shapes, such as a substantially cylindrical shape. FIG. 7 is a schematic illustration of sole structure 110 in an assembled condition. As shown in FIG. 7, projections 205 may extend through apertures 120 and may be exposed to the ground and configured to contact the ground.

The lower tips of the sensory feedback members may be deflected substantially horizontally under loading in a lateral direction (i.e., shear forces with the surface in which the sole structure is in contact). Upon horizontal deflection of the lower portions of the sensory feedback members, the upper portions in contact with the wearer's foot may deflect horizontally in the opposite direction from the lower portions. The location and amount of deflection of the upper portions indicates to the wearer the amount of lateral loading, the shape of the structure in contact with the sole of the footwear, the positioning of the foot against the structure, as well as the speed of the foot relative to the structure before contact, and the direction of movement of the foot relative to the structure before contact.

Figure 8:
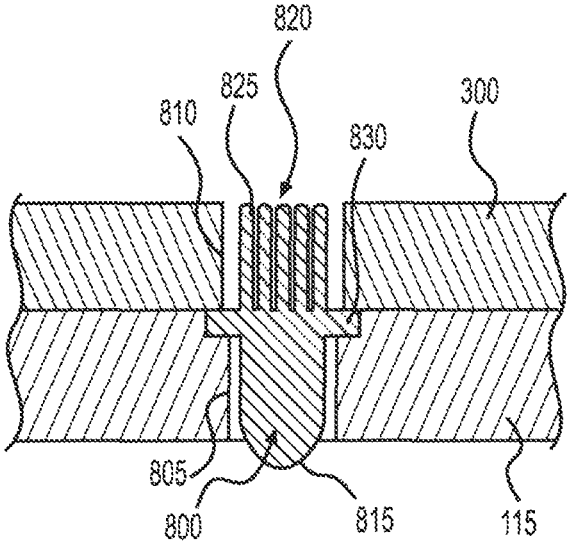
FIG. 8 is a schematic illustration of cross-sectional view of an embodiment of a sensory feedback member in an unloaded condition.

FIG. 8 is a schematic illustration of cross-sectional view of an embodiment of a sensory feedback member 800 in an unloaded condition. As shown in FIG. 8, sensory feedback member 800 may include a first end having a projection 815 extending through a first aperture 805 in outer member 115. In addition, sensory feedback member 800 may include a flange portion 830 secured between outer member 115 and midsole 300. Further, sensory feedback member 800 may have a second end including a plurality of bristles 820 extending through a second aperture 810 in midsole 300. Tips 825 of bristles 820 may be exposed at a top surface of midsole 300. It will be noted that first aperture 805 may be larger than projection 815 in order to provide space for projection 815 to deflect horizontally under loading. Similarly, second aperture 810 may be larger than bristles 820 in order to allow bristles 820 to deflect under loading.

Figure 9:
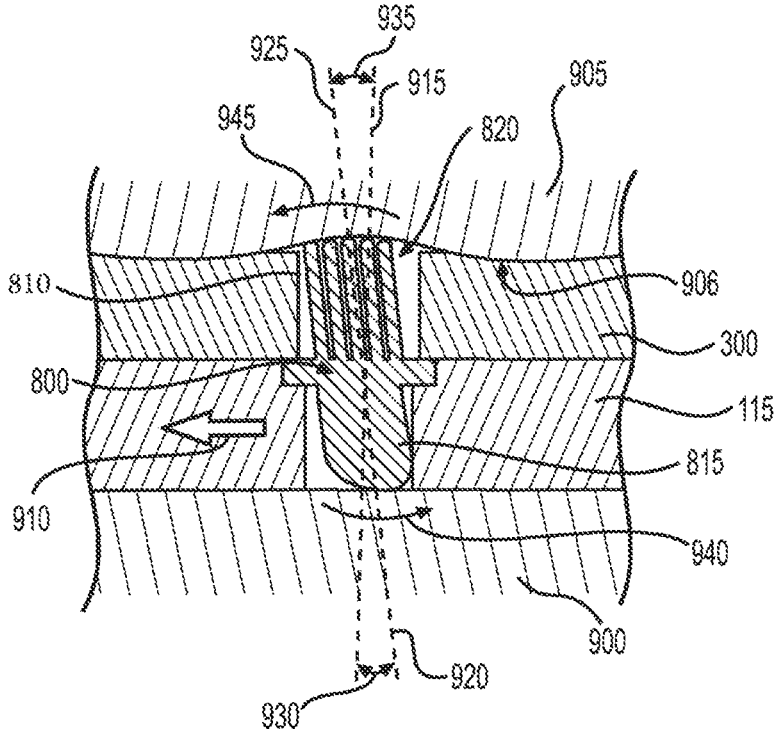
FIG. 9 is a schematic illustration of a cross-sectional view of the sensory feedback member of FIG. 8 in a horizontally loaded condition.

FIG. 9 is a cross-sectional view of sensory feedback member 800 in a horizontally loaded condition. Specifically, FIG. 9 illustrates a ground surface 900 and a foot 905. As shown in FIG. 9, foot 905 is applying a horizontal force in the direction of a first arrow 910 while also applying a vertical load against ground 900. During this loading, projection 815 is compressed slightly and deflected in the direction of a second arrow 940 in a first substantially horizontal direction.

In addition, upon the deflection of projection 815 in the direction of arrow 940, bristles 820 may deflect in a second substantially horizontal direction indicated by a third arrow 945. As show in FIG. 9, the second substantially horizontal direction may be substantially opposite the first substantially horizontal direction. The deflection of projection 815 and bristles 820 from a vertical axis 915 is shown in FIG. 9. In particular, projection 815 may have a first central axis 920, which may deflect away from vertical axis 915 as indicated by a fourth arrow 930. Similarly, bristles 820 may have a second central axis 925, which may deflect away from vertical axis 915 as indicated by a fifth arrow 935. As shown in FIG. 9, in some embodiments, the amount of deflection of projection 815 and bristles 820 may be substantially similar, as indicated by the substantial alignment of first central axis 920 and second central axis 925. In other embodiments, one of projection 815 or bristles 820 may be configured to deflect more than the other. Such disparate deflection may be effectuated by providing projection 815 and bristles 820 with different lengths from one another.

As shown in FIG. 9, upon vertical loading, midsole 300 may compress, thus allowing bristles 820 to apply pressure against the bottom surface 906 of foot 905. This application of pressure against foot 905 by bristles 820, enables the horizontal deflection of bristles 820 to be felt by the foot, thus transmitting feedback from the deflection of projection 815 due to contact with ground 900.

In some embodiments, sensory feedback 800 being configured to contact the ground and deflect multi-axially in substantially horizontal directions. For example, projection 815 may be configured for multi-axial horizontal deflection. Similarly, the second end of sensory feedback member 800 including bristles 820 may be configured for multi-axial horizontal deflection. That is, the projection and bristles may deflect in any horizontal direction. This feature may be facilitated by the radial symmetry of sensory feedback member 800. Accordingly, sensory feedback member 800 may deflect in substantially the same way, regardless of which direction the loading is applied. In other embodiments, the sensory feedback members may be biased for more deflection in certain directions and less deflection in other directions. Such biased sensory feedback members may be selectively located at predetermined portions of the foot.

Figure 10:
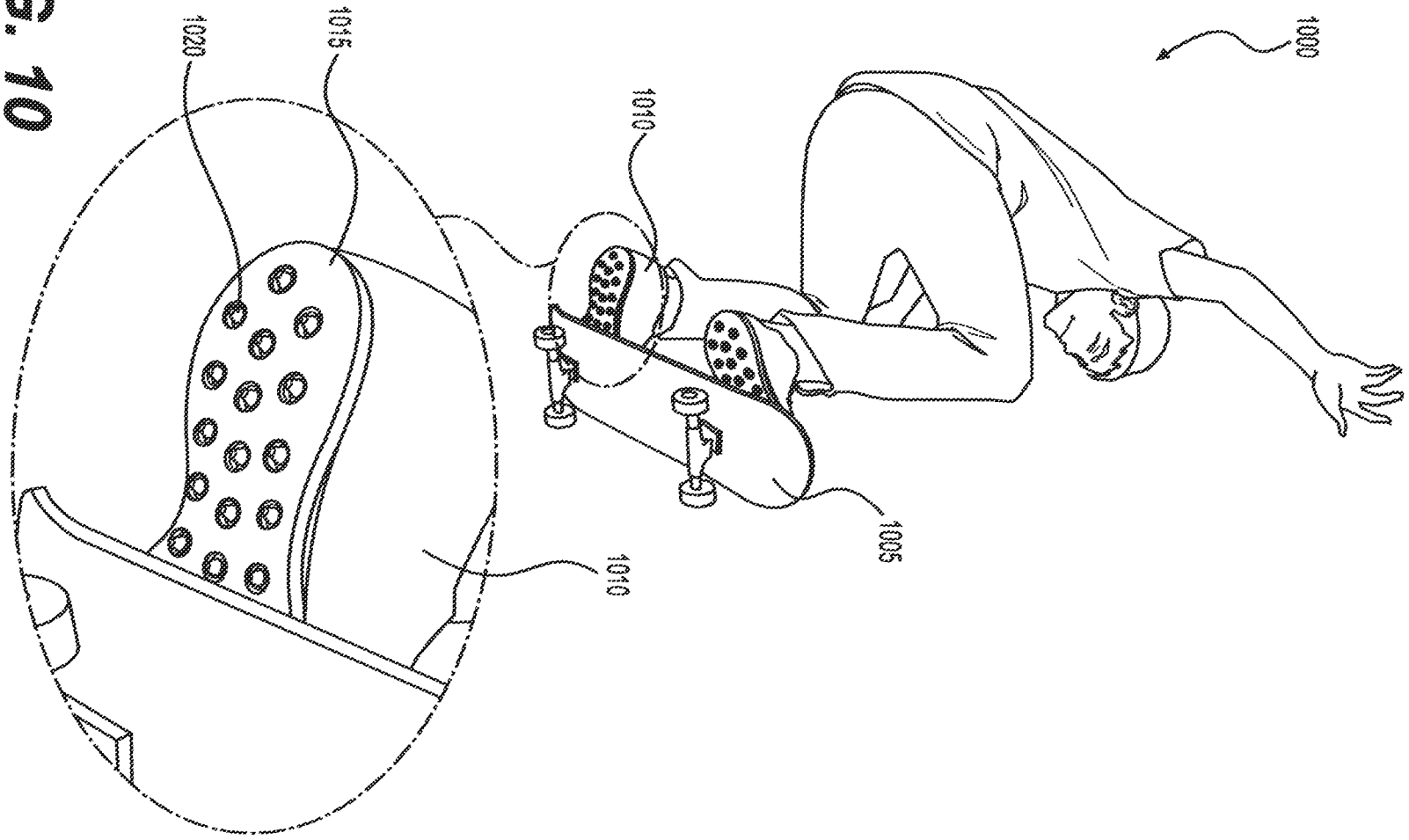
FIG. 10 is a schematic illustration of a skateboarder wearing footwear including sensory feedback members.
Figure 11:
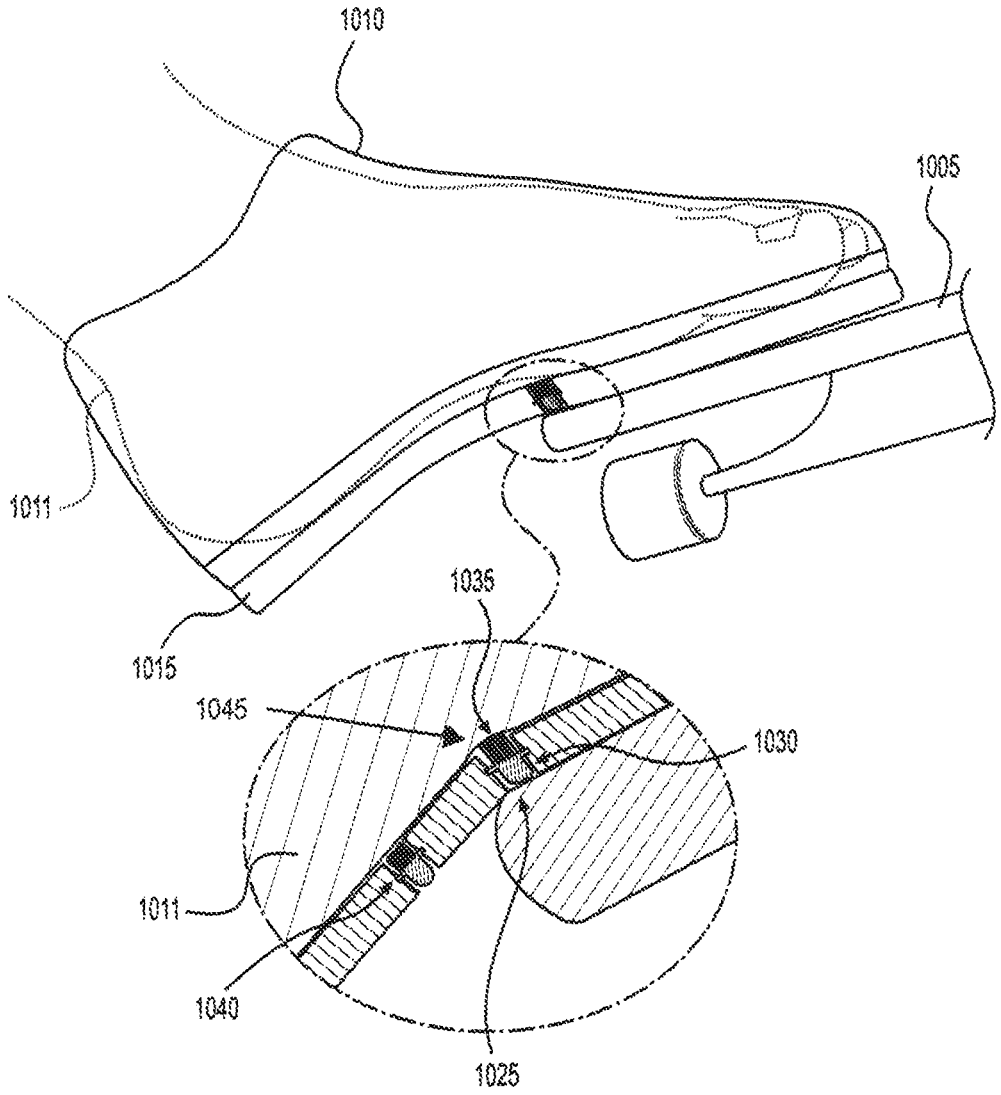
FIG. 11 is a schematic illustration of a skateboarder's footwear standing on an edge of a skateboard and further shows a cross-sectional view of the sole structure of the footwear.

FIG. 10 is an illustration of a skateboarder 1000 on a skateboard 1005, wearing an article of footwear 1010 including sensory feedback members 1020 incorporated into a sole structure 1015 of footwear 1010. As illustrated in FIG. 10, some skateboarding tricks involve positioning of the feet along the edge of the board. FIG. 11 illustrates the interaction of sole structure 1015 with an edge 1025 of skateboard 1005.

As shown in FIG. 11, a first sensory feedback member 1040 may be located in a portion of sole structure 1015 that is not in contact with skateboard 1005, and thus, may be unloaded and, consequently, not deflected. A second sensory feedback member 1045 may be in contact with edge 1025 of skateboard 1005. As further shown in FIG. 11, second sensory feedback member 1045 may include a projection 1030 in contact with edge 1025 of skateboard 1005. Further, second sensory feedback member 1045 may include bristles 1035 in contact with foot 1011 of the wearer. Since first sensory feedback member 1040 and second sensory feedback member 1045 are adjacent one another, but transmit different feedback to foot 1011, the skateboarder may be able to detect the location of edge 1025 of skateboard 1005 against their foot 1011.

In a similar way this edge detection may benefit skateboarders in precisely positioning their foot on a skateboard, this sensory feedback configuration may also provide increased sensory feedback for racecar drivers. In some cases, racecar drivers may find it beneficial to have improved feel of edges of pedals. For example, during heel-toe shifting techniques, the driver may rock his foot from side to side on the edge of the brake pedal, while applying pressure against the accelerator. Control and precision in performing this and other driving techniques may be provided by sensory feedback members disclosed herein.

The amount of sensory feedback provided by sensory feedback members may be tuned by selecting the compressibility of the outer member and the midsole. For example, using more compressible materials for the outer member and the midsole will enable the sensory feedback members to apply more pressure to the foot of a wearer. In addition, the amount of feedback may also be tuned by selecting the length of the sensory feedback members relative to the thickness of the sole structure. For example, in some cases, the bristles may extend beyond an upper surface of the midsole. Alternatively, the tips of the bristles may be flush with the upper surface of the midsole. In some embodiments, the tips of the bristles may be recessed within the aperture in the midsole.

Figure 12:
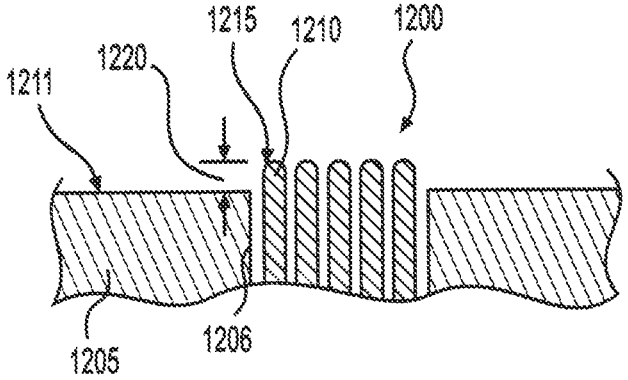
FIG. 12 is a schematic illustration of an embodiment of bristles of a sensory feedback member.

FIG. 12 illustrates a sensory feedback member 1200 disposed within an aperture 1206 in a midsole 1205. As shown in FIG. 12, in some embodiments, a distal end 1215 of bristles 1210 may extend a distance 1220 beyond an upper surface 1211 of midsole 1205 that is exposed to the internal cavity of the upper.

Figure 13:
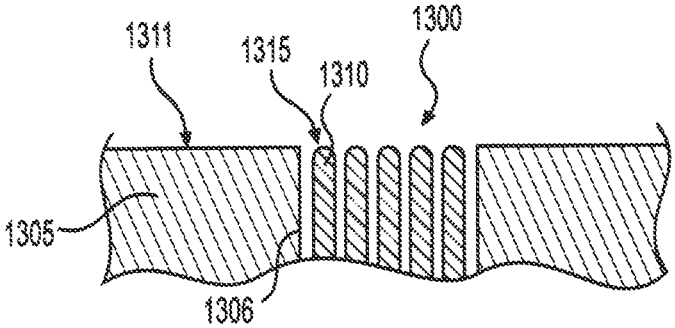
FIG. 13 is a schematic illustration of another embodiment of bristles of a sensory feedback member.

FIG. 13 illustrates a sensory feedback member 1300 disposed within an aperture 1306 in a midsole 1305. As shown in FIG. 13, in some embodiments, bristles 1310 of sensory feedback member 1300 may extend to a distal end 1315 that is flush with an upper surface 1311 of midsole 1305 that is exposed to the internal cavity of the upper.

Figure 14:
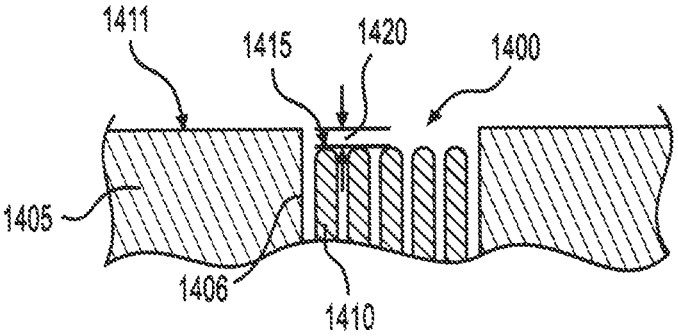
FIG. 14 is a schematic illustration of another embodiment of bristles of a sensory feedback member.

FIG. 14 illustrates a sensory feedback member 1400 disposed within an aperture 1406 in a midsole 1405. As shown in FIG. 14, in some embodiments, a distal end 1415 of bristles 1410 of sensory feedback member 1400 may be recessed from an upper surface 1411 of midsole 1405 that is exposed to the internal cavity of the upper.

Figure 15:
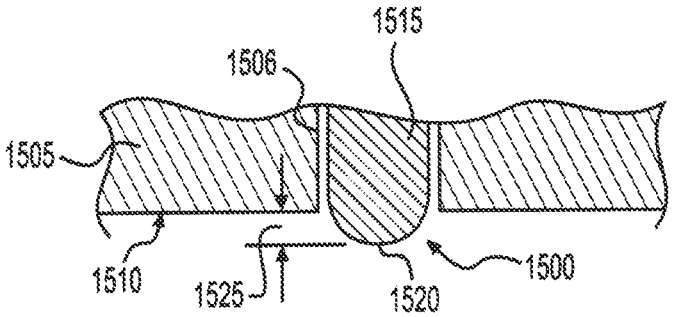
FIG. 15 is a schematic illustration of an embodiment of a ground-contacting projection of a sensory feedback member.

FIG. 15 illustrates a sensory feedback member 1500 disposed within an aperture 1506 in an outer member 1505. As shown in FIG. 15, in some embodiments, a distal end 1520 of a projection 1515 of sensory feedback member 1500 may extend a distance 1525 beyond an exposed surface 1510 of outer member 1505.

Figure 16:
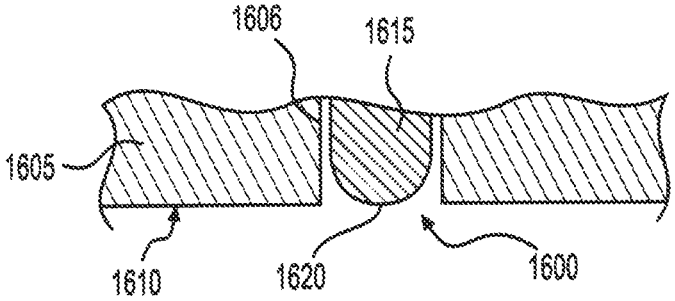
FIG. 16 is a schematic illustration of another embodiment of a ground-contacting projection of a sensory feedback member.

FIG. 16 illustrates a sensory feedback member 1600 disposed within an aperture 1606 in an outer member 1605. As shown in FIG. 16, in some embodiments, a projection 1615 of sensory feedback member 1600 may extend to a distal end 1620 that is flush with an exposed surface 1610 of outer member 1605.

Figure 17:
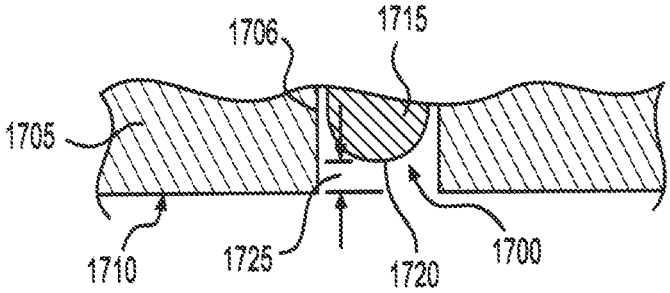
FIG. 17 is a schematic illustration of another embodiment of a ground-contacting projection of a sensory feedback member.

FIG. 17 illustrates a sensory feedback member 1700 disposed within an aperture 1706 in an outer member 1705. As shown in FIG. 17, in some embodiments, a distal end 1720 of a projection 1715 of sensory feedback member 1700 may be recessed from an exposed surface 1710 of outer member 1705.

The sensory feedback members may be substantially flexible and resilient. For example, in some embodiments, the sensory feedback members may be formed of a flexible rubber. This rubber may be the same or substantially similar to the rubber used for the outer member. This flexibility may enable the deflection of the projections and the bristles in substantially horizontal directions, as discussed above. In addition, due to the substantially flexible construction and the use of a plurality of bristles on the upper side of the sole structure, the bristles may readily collapse under vertical loading. This may provide increased comfort to the wearer as compared to a more rigid, pillar-like structure.

Figure 18:
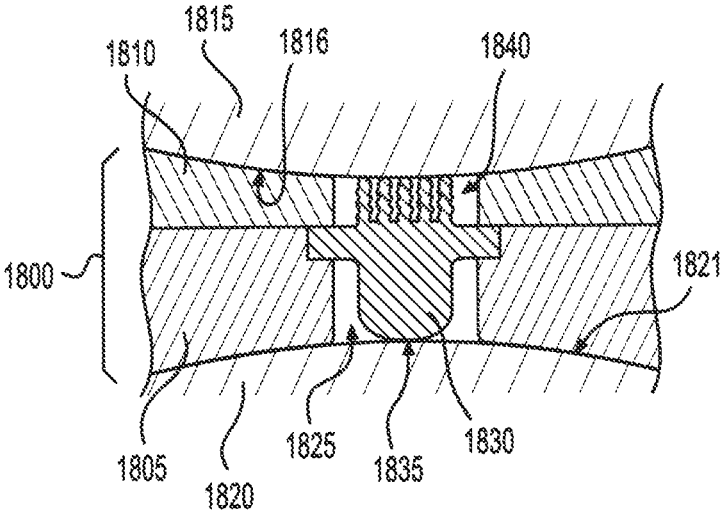
FIG. 18 is a schematic illustration of a sensory feedback member in a vertically loaded condition.

FIG. 18 is a schematic illustration of a sole structure 1800, including a sensory feedback member 1840 in a vertically loaded condition. As shown in FIG. 18, sole structure 1800 may include an outer member 1805 and a midsole 1810 defining an aperture 1825 through sole structure 1800. Within aperture 1825, sensory feedback member 1840 may include a projection 1830 and a plurality of bristles 1840. FIG. 18 illustrates a foot 1815 of a wearer applying vertical loading against the ground 1820. As shown in FIG. 18, when a distal tip 1835 of projection 1830 is pressed against a surface 1821 of ground 1820, projection 1830 may compress slightly and, in some cases, may bulge laterally. In addition, when bristles 1840 are pressed against the lower surface 1816 of foot 1815, bristles 1840 may collapse, as shown by the wavy configuration of bristles 1840 in FIG. 18.

Figure 19:
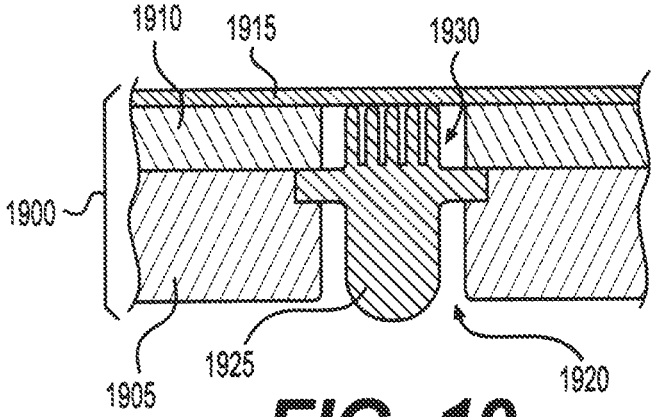
FIG. 19 is a schematic illustration of another sole structure configuration including a sensory feedback member.

In some embodiments, a relatively thin insole or sockliner may be incorporated, covering the sensory feedback members inside the shoe. For example, FIG. 19 shows a sole structure 1900, including an outer member 1905, a midsole 1910, and an insole 1915. Sole structure 1900 may also include a sensory feedback member 1920, which may include a projection 1925 and a plurality of bristles 1930. As shown in FIG. 19, insole 1915 may be substantially thinner than midsole 1910. This relatively thin structure of insole 1915 may permit deflection of bristles 1930 to be felt by the wearer through insole 1915.

Figure 20:
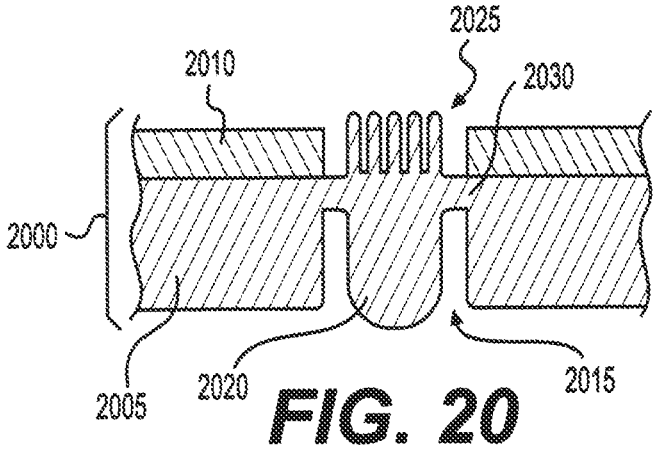
FIG. 20 is a schematic illustration of a sensory feedback member that is integrally formed with an outer member of a sole structure.

In addition, while previous embodiments have been shown and discussed to include separately formed outer members, midsoles, and sensory feedback members, in some embodiments, the sensory feedback members may be formed substantially integral with the midsole and/or the outer member. FIG. 20 is a schematic illustration of a sole structure 2000 including an outer member 2005 and a midsole 2010. As shown in FIG. 20, sole structure 2000 may include a sensory feedback member 2015 that is integrally formed with outer member 2005 as a unitary structure. For example, as shown in FIG. 20, sensory feedback member 2015 may include a projection 2020 and a plurality of bristles 2025 that are both formed as a single piece of material with outer member 2005.

While various embodiments have been described, the description is intended to be exemplary, rather than limiting and it will be apparent to those in the art that many more embodiments and implementations are possible that are within the scope of the current embodiments. Accordingly, the current embodiments are not to be restricted except in light of the attached claims and their equivalents. Features described in one embodiment may or may not be included in other embodiments are described herein. Also, various modifications and changes may be made within the scope of the attached claims.

I claim:

1. A sole structure of an article of footwear, comprising:

an exposed outer member with an upper surface and a lower surface, the lower surface being configured to contact the ground;

a first plurality of apertures in the exposed outer member, the first plurality of apertures extending from the upper surface to the lower surface;

a plurality of recessed grooves on the upper surface of the exposed outer member, the plurality of recessed grooves extending between at least some of the first plurality of apertures to connect with adjacent apertures of the first plurality of apertures; and a plurality of sensory feedback members extending through respective ones of the first plurality of apertures, wherein the first plurality of apertures comprise a first aperture, second aperture, and a third aperture, and the plurality of recessed grooves comprise a first groove, a second groove, and a third groove, and the first groove extends between the first aperture and the second aperture, the second groove extends between the second aperture and the third aperture, and the third groove extends between the first aperture and the third aperture.

2. The sole structure of claim 1, further comprising a plurality of connecting members that extend between at least some of the plurality of sensory feedback members, wherein the plurality of connecting members are disposed at least partially within the plurality of recessed grooves.

3. The sole structure of claim 2, wherein each of the plurality of sensory feedback members are coupled by respective ones of the plurality of connecting members to at least two other adjacent ones of the plurality of sensory feedback members.

4. The sole structure of claim 2, wherein the plurality of connecting members are disposed between a lower surface of a midsole and an upper surface of the exposed outer member.

5. The sole structure of claim 1, wherein the plurality of sensory feedback members include a first end that extends beyond the lower surface of the exposed outer member and a second end that extends beyond the upper surface of the exposed outer member.

6. The sole structure of claim 5, wherein the second end of respective ones of the plurality of sensory feedback members comprises a plurality of flexible bristles.

7. The sole structure of claim 1, wherein the sole structure comprises a midsole disposed on the upper surface of the exposed outer member.

8. The sole structure of claim 1, further comprising a midsole, wherein the midsole comprises a second plurality of apertures, and the plurality of sensory feedback members extend through respective ones of the second plurality of apertures.

9. The sole structure of claim 1, wherein the first plurality of apertures are circular.

10. A sole structure comprising:

an outer member;

a plurality of sensory feedback members, each including a first end that contacts a ground surface and a second end that extends upward away from the ground surface, the first end having a different shape from the second end;

a first plurality of apertures in the outer member through which respective ones of the plurality of sensory feedback members extend; and a plurality of connecting members extending between respective ones of the plurality of sensory feedback members, wherein each of the plurality of sensory feedback members are linked by respective ones of the plurality connecting members such that each of the plurality of sensory feedback members are linked to at least two other adjacent sensory feedback members by the plurality of connecting members, and wherein the second end has a plurality of independently movable surfaces.

11. The sole structure of claim 10, wherein the plurality of independently movable surfaces comprise a plurality of flexible bristles.

12. The sole structure of claim 10, wherein the first end of the plurality of sensory feedback members extends beyond a lower surface of the outer member and the second end of the plurality of sensory feedback members extends beyond an upper surface of the outer member.

13. The sole structure of claim 12, further comprising a midsole positioned above the outer member, the midsole comprising a second plurality of apertures aligned with the first plurality of apertures.

14. The sole structure of claim 13, wherein the second end of the plurality of sensory feedback members extends through respective ones of the second plurality of apertures and beyond an upper surface of the midsole.

* * * * *